United States Patent [19]

Nishida et al.

[11] Patent Number: 4,527,624

[45] Date of Patent: Jul. 9, 1985

[54] COOLING DEVICE FOR REFRIGERATOR

[75] Inventors: Susumu Nishida, Katano; Tadashi Fuchigami, Hirakata; Seiji Kimura, Yao; Shunsaku Kishi, Shigino-Nishi; Akio Kobayashi, Hirakata, all of Japan

[73] Assignee: Sanyo Electric Co., Ltd., Japan

[21] Appl. No.: 621,430

[22] Filed: Jun. 18, 1984

[30] Foreign Application Priority Data

Jun. 20, 1983 [JP] Japan ..... 58-111313
Nov. 28, 1983 [JP] Japan ..... 58-224788

[51] Int. Cl.[3] ..... F28F 1/14; F28F 1/36

[52] U.S. Cl. ..... 165/184; 62/275; 62/515

[58] Field of Search ..... 165/182, 184; 62/515, 62/275

[56] References Cited

U.S. PATENT DOCUMENTS

| | | | |
|---|---|---|---|
| 1,516,430 | 11/1924 | Hess | 165/184 X |
| 3,887,004 | 6/1975 | Beck | 165/184 X |
| 4,065,264 | 12/1977 | Lewin | 165/184 X |
| 4,430,868 | 2/1984 | Kern et al. | 62/515 |
| 4,438,808 | 3/1984 | Venables et al. | 165/184 X |

*Primary Examiner*—Lloyd L. King
*Attorney, Agent, or Firm*—Darby & Darby

[57] ABSTRACT

A cooling device for a refrigerator comprising a plurality of cooling tubes, each of the cooling tubes being formed by helically winding a thermally conductive metal pipe having radial spine fins over the entire periphery thereof, being substantially in parallel to the axis of helix thereof and being connected together through a bent connection portion, to provide a continuous refrigerant passageway.

17 Claims, 7 Drawing Figures

COOLING DEVICE FOR REFRIGERATOR

BACKGROUND OF THE INVENTION

1. Field of the Invention

The present invention relates to a cooling device for refrigerators, and more particularly to a cooling device which is provided in the cold air circulation channel of a refrigerator of the forced circulation type wherein cold air is forcedly circulated by a fan to cool a refrigerator compartment or freezer compartment.

2. Description of the Prior Art

Cooling devices for refrigerators of the forced circulation type must efficiently cool the air to be forcedly circulated by a fan. These devices usually comprise a finned tube.

Already known as such tubes are one comprising a tube and plate fins attached to the tube transversely thereof and arranged longitudinally of the tube at equal spacing as disclosed in U.S. Pat. No. 3,252,292, and one comprising a tube and radial spine fines helically wound around the tube as disclosed in U.S. Pat. No. 3,022,049.

For use in refrigerators with improved cooling efficiency, another cooling device is known which comprises a finned tube helically bent into a tubular form as disclosed in U.S. Pat. No. 3,766,679. The fins in this case are radial spine fins but are provided only inside the tubular body.

SUMMARY OF THE INVENTION

The present invention provides a cooling device for refrigerators which comprises a plurality of cooling tubes, each of the tubes being formed by helically winding a thermally conductive metal pipe having radial spine fins over the entire periphery thereof, being substantially in parallel to the axis of helix thereof and being connected together through a bent connection portion, to provide a continuous refrigerant passageway.

The invention further provides a cooling device of the type described wherein each of the cooling tubes has a through bore defined by the tips of spine fins thereon and coaxial with the helix thereof, and a defrosting electric pipe heater is inserted in the bore in pressing contact with the fin tips.

The cooling device of the present invention for use in refrigerators has the structural feature that radial spine fins are provided over the entire periphery of a pipe which is wound helically. Because of this feature, the present device has a greatly reduced size and yet achieves a high heat exchange efficiency, thereby permitting the refrigerator to have a cold air circulation channel of reduced size and consequently giving a reduced overall size to the refrigerator without altering the sizes of the refrigerator compartment and the freezer compartment.

Another important feature of the present cooling device is that the device having the foregoing structural feature can be produced by a novel method as will be described later.

Further making use of the structural feature of the cooling device of the invention, a defrosting electric pipe heater is inserted in the spine fin pipe coaxially of its helix in pressing contact with fin tips, whereby an increased defrosting efficiency can be achieved.

DESCRIPTION OF THE PREFERRED EMBODIMENTS

Figure 1:
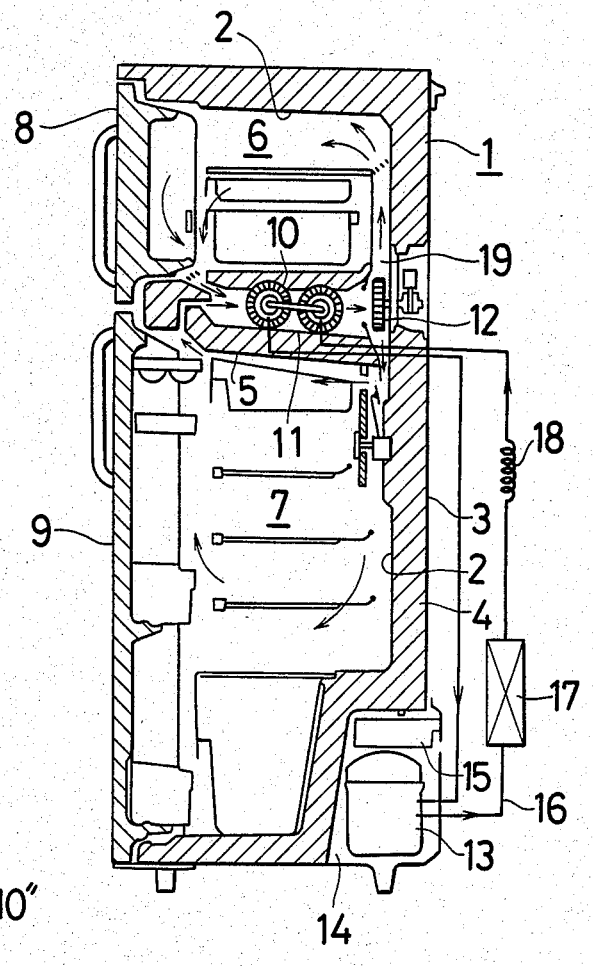
FIG. 1 is a view in vertical section showing a refrigerator incorporating an embodiment of cooling device of the present invention.

First, the present invention will be described with reference to the embodiment shown in FIGS. 1 to 3. Indicated at 1 is the main body of a refrigerator having an inner case 2 and an outer case 3, with an expanded heat insulator 4 filled in the space therebetween. The interior of the main body 1 is separated by a partition 5 to provide a freezer compartment 6 in the upper portion and a refrigerator compartment 7 in the lower portion. The freezer compartment 6 and the refrigerator compartment 7 have doors 8 and 9, respectively, for openably closing their front openings. The refrigerator has a cooling device 10 disposed above a frost water receptacle 11 within the partition 5, an electric fan 12 disposed in the rear of the cooling device for forcedly circulating cold air through the two compartments 6 and 7, a compressor 13 disposed in a machine chamber 14 at a lower rear portion of the main body 1, and an evaporator tray 15 provided above the compressor 13 for evaporating the water resulting from defrosting, utilizing the heat released from the compressor 13. The compressor 13, a condenser 17, a capillary tube 18 serving as an expansion valve, the cooling device 10 serving as an evaporator and the compressor 13 are interconnected in a loop form in the order mentioned by a refrigerating cycle 16 incorporating a refrigerant. Cold air is circulated through the refrigerator compartment 7 and the freezer compartment 6 through a cold air circulation channel 19.

The cooling device 10 has the following construction. Tubes (or pipes) 11*a*, 12*a* of copper or like material having high thermal conductivity are provided, over the entire periphery thereof, with radial spine fins 11*b*, 12*b* of aluminum material to form spine fin tubes 10', 10'', which are helically wound into a tubular form. The spine fin tube 10' is positioned upstream (the flow of cold air is indicated by arrows A in FIG. 1) from the other spine fin tube 10'' in parallel therewith and in opposite relation thereto in respect of the direction of helix. The tubes 10', 10'' are interconnected by a pipe 13*c* of the same material as the tubes 11*a*, 12*a*. Thus, the cold obtained by evaporation of the refrigerant is delivered to air through the spine fins on the entire peripheral surfaces of the tubes. Moreover, since air flows through the cooling device 10 in bent streams as indicated by arrows B1 and B2, air effectively comes into contact with the fin tubes to be fully cooled by the device.

The pitch of helix P1 of the spine tube 10' in the upstream position is larger than the pitch of helix P2 of the spine tube 10'' in the downstream position. (For example, P1= and P2=41 mm). Accordingly frosting occurs uniformly over the entire device to preclude uneven flow of cold air, whereby an increased cooling efficiency can be achieved by the device.

The fins 11*b*, 12*b* are attached to the tubes 11*a*, 12*a* (for example, 9.0 mm in outside diameter and 8.0 mm in inside diameter) by the following method. First, a thin aluminum strip (24.0 mm in width and 0.2 mm in thickness) is bent into a channel form having elongated opposed pieces (11.0 mm in length) and an interconnecting portion (2.0 mm in length) of the opposed pieces, and incisions are formed in the opposed pieces at a small spacing (0.8 mm) to provide spines. The bent strip formed with the spine fins is then wound around the tube, with the outer surface of the interconnecting portion in intimate contact with the surface of the tube (see, for example, U.S. Pat. No. 3,134,166).

Figure 4A:
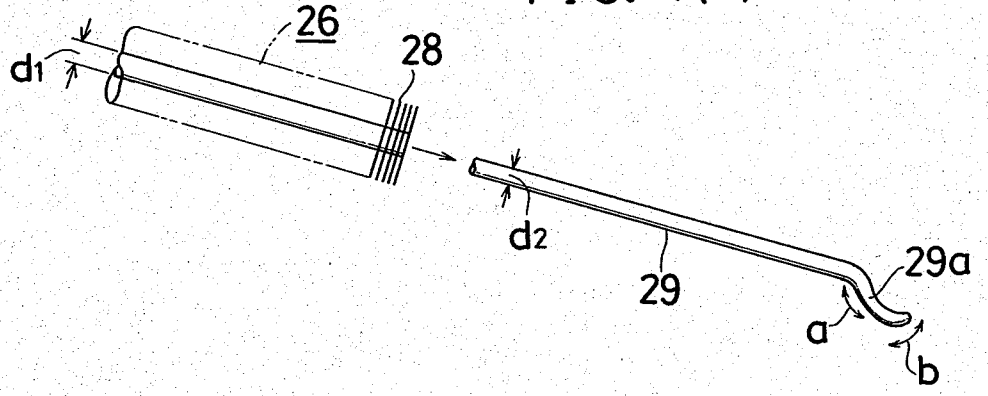
FIGS. 4 (*a*) and (*b*) are diagrams showing the successive steps of making the cooling tube of the device shown in FIGS. 2 and 3.
Figure 4B:
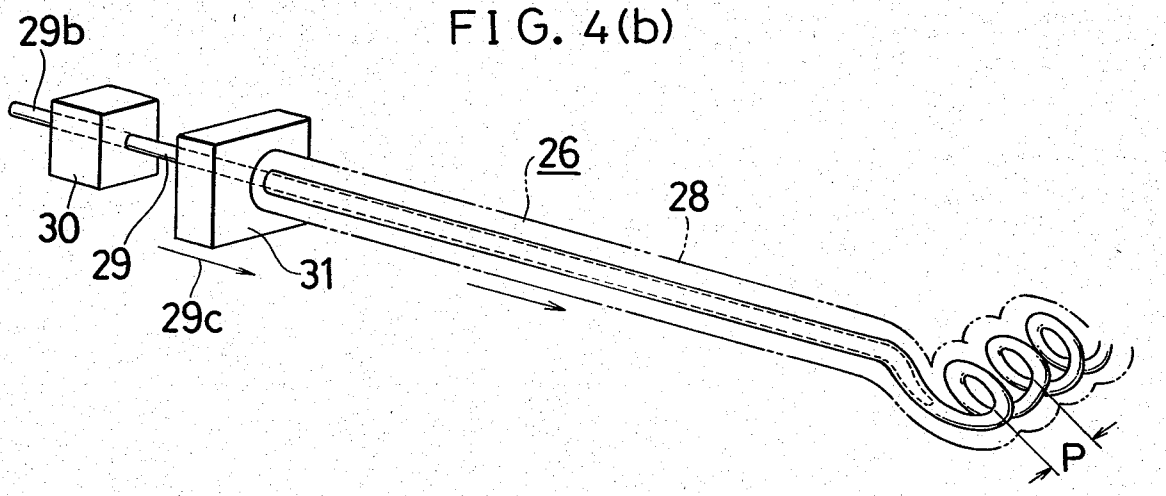

The spine fin tube thus obtained is helically wound by the method to be described below with reference to FIGS. 4 (*a*) and (*b*).

A jig 29 for helically bending a spine fin tube 26 has an outside diameter d2 (8.0 mm) slightly smaller than the inside diameter d1 (9.0 mm) of the tube 26 by an amount for forming a suitable clearance. The jig extends substantially straight and has a forward end 29*a* which has a curve (indicated by an arrow a) corresponding to the curve of the helix and a twist (indicated by an arrow b) corresponding to the pitch P of helix. The straight portion of the jig 29 is inserted through the tube 26, and a fixing jig 30 is then secured to the exposed portion 29*b* of the jig 29 to thereby fixedly support the jig 29. A feeding member 31 is thereafter sliding moved on the jig 29 in the direction of arrow c by a feeder (not shown). Consequently the tube 26 is pushed forwardly of the jig 29 by the feeding member 31. When the tube 26 passes over the forward end 29*a* of the jig 29, the tube is helically bent in conformity with the curve (of arrow a) and, at the same time, bent inconformity with the twist (of arrow b) so as to have the pitch P. Thus the tube is helically bent as desired.

In this way, the spine fin tube can be easily formed into a helix without causing damage to the spine fins on its entire peripheral surface, by utilizing the internal space of the tube, i.e. by inserting the jig through the tube.

When a spine fin tube is to be helically wound, it is usually necessary to apply an external force thereto, but the spine fins, which have very low rigidity, then inevitably become deformed, failing to perform the comtemplated function. To avoid this problem, it was therefore necessary to provided spine fins limitedly on a portion of the surface of the tube as is the case with the cooling device disclosed in the aforementioned U.S. Pat. No. 3,766,976. However, the problem has been overcome by the forming method of the invention wherein the internal space of the tube is utilized.

The embodiment shown in FIGS. 5 and 6 will now be described.

Figure 3:
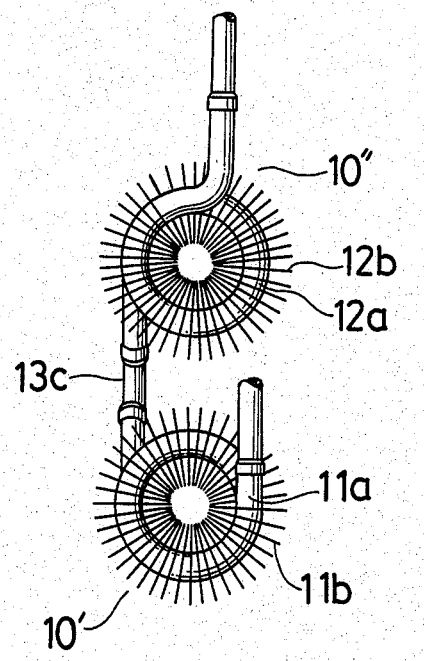
FIG. 3 is a right side elevation of FIG. 2.
Figure 2:
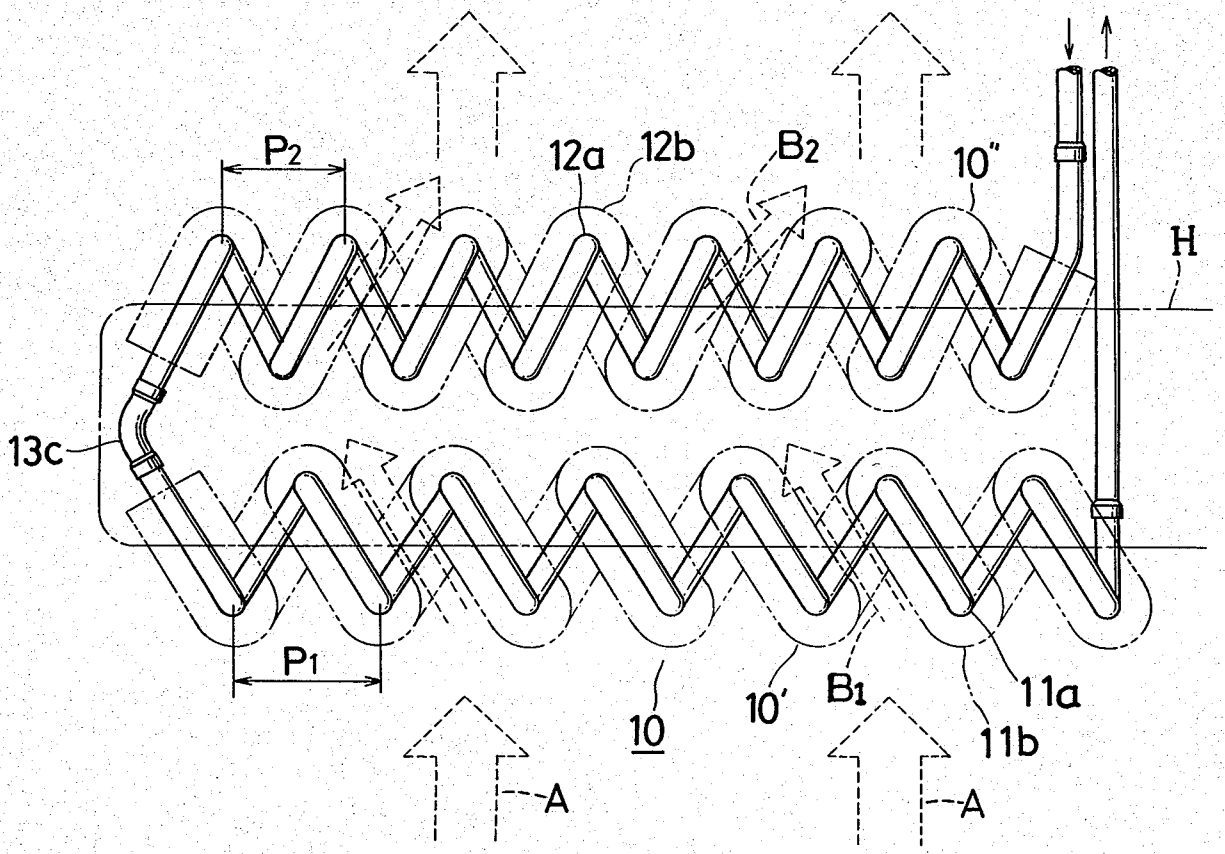
FIG. 2 is a plan view of the cooling device.

The cooling device 100, like the one shown in FIGS. 1 to 3, is provided in a suitable portion of the cold air circulation channel. However, the second embodiment differs from the first in that it has a defrosting electric pipe heater. A spine fin tube 120 is made of copper, aluminum or like metal having relatively high thermal conductivity and is in the form of a helix having a pitch P and an inside diameter D1 as specified. A pipe heater 123 comprises a heater wire 124 covered with an insulator and inserted in a metal pipe 125, which is completely sealed off at its opposite ends with rubber or like elastic member 126. The outside diameter D2 (9.0 mm) of the heater is slightly larger than the inside diameter D1 (8.0 mm) of the helix, i.e. through bore, of the spine fin tube 120. The pipe heater 123, as inserted in the interior of the helix of the tube 120, is resiliently supported by spine fins 122. The metal pipe 125 of the heater 123 is made of copper, aluminum or like material having high thermal conductivity. Accordingly the heat of the metal pipe 125 rapidly diffuses through the spine fins 122. The present embodiment has the same dimensions as the embodiment of FIG. 1. Indicated at 127 in FIG. 5 is a portion for interconnecting two opposed tubes. The connecting portion has no spine fins. This renders the metal pipe 125 easily insertable through the two tubes in the direction of arrow shown. Indicated at 128 is a flat pipe portion which is suitable for mounting a defrosting sensor thermostat thereon.

Because the heat of the pipe heater rapidaly diffuses through a large number of spine fins in contact with the heater, the surface of the heater is maintained at a low temperature close to frost thawing temperature to prevent generation of steam and preclude undesired rise of the internal temperature of the refrigerator which is equipped with the present device.

The pipe heater, which is supported by the spine fins, does not require a specific support or the like. This assures a simple construction.

Figure 5:
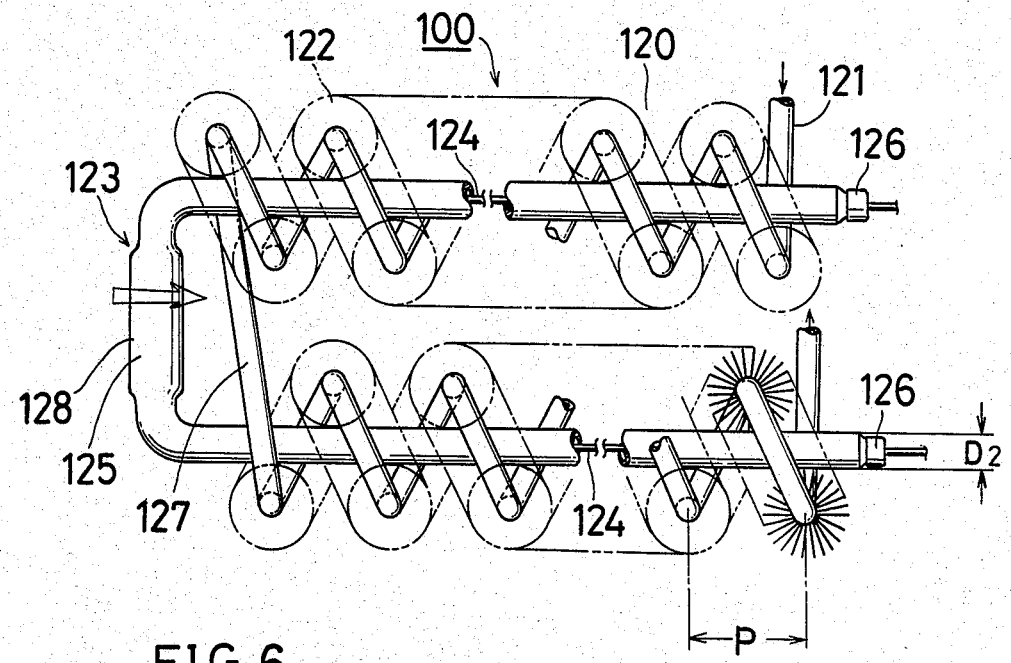
FIGS. 5 and 6 are views corresponding to FIGS. 2 and 3 and showing another embodiment of cooling device of the invention.
Figure 6:
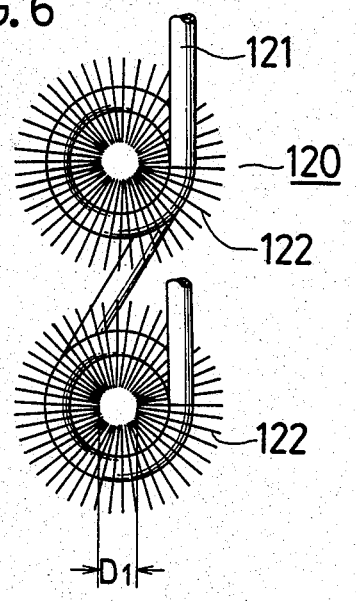

The cooling device 10 shown in FIGS. 1 to 3 can be provided with a pipe heater such as the one shown in FIGS. 5 and 6 (in the position indicated in a broken line H in FIG. 2).

Irrespective of the presence or absence of the pipe heater, the spine fin tubes of FIGS. 1 to 3 can be identical in the direction and pitch of the helix.

What is claimed is:

1. A cooling device for use in a refrigerator having a cooled air passageway for flow of air, said cooling device comprising:

a plurality of helically wound thermally conductive metal pipes, the helical axes of said pipes being substantially parallel to each other and generally perpendicular to the direction of air flow through said cooled air passageway, at least one pipe being downstream in the direction of air flow of another pipe in said cooled air passageway;

radial spine fins projecting from the entire surface of each pipe;

each pipe being connected to another pipe through a bent connection portion, to provide a continuous refrigerant passageway.

2. A cooling device as defined in claim 1 wherein two of said pipes are connected together in a substantially U-shaped arrangement so that one pipe is further upstream in said cooled air passageway than said other pipe.

3. A cooling device as defined in claim 1 wherein adjacent pipes spiral in opposite directions.

4. A cooling device as defined in claim 1 wherein adjacent pipes spiral in the same direction.

5. A cooling device as defined in claim 2 wherein the helical pitch of said upstream pipe is smaller than the helical pitch of said downstream pipe.

6. A cooling device as defined in claim 1 wherein said pipes have substantially identical helical pitch.

7. A cooling device for use in a refrigerator having a cooled air passageway for flow of air, said cooling device comprising:

a plurality of helically wound thermally conductive metal pipes, the helical axes of said pipes being substantially parallel to each other and generally perpendicular to the direction of air flow through said cooled air passageway;

radial spine fins projecting from the entire surface of each pipe;

each pipe being connected to another pipe through a bent connection portion to provide a continuous refrigerant passageway;

said spine fins in an area circumscribed by each said helical pipe being shorter in length than the helix radius, to define a through bore extending along each helical pipe axis; and a defrosting heater mounted in said bore in thermally conductive relationship to said circumscribed spine fins.

8. A cooling device as defined in claim 7 wherein two of said pipes are connected together in a substantially U-shaped arrangement so that one pipe is further upstream in said cooled air passageway than said other pipe.

9. A cooling device as defined in claim 7 wherein adjacent pipes spiral in opposite directions.

10. A cooling device as defined in claim 7 wherein adjacent pipes sprial in the same direction.

11. A cooling device as defined in claim 8 wherein the helical pitch of said upstream pipe is smaller than the helical pitch of said downstream pipe.

12. A cooling device as defined in claim 7 wherein said pipes have substantially identical helical pitch.

13. A cooling device as defined in claim 8 wherein said bent connection portin of conductive metal pipe has no spine fins.

14. A cooling device as defined in claim 13 wherein said defrosting heater is substantially U-shaped in conformity with the U-shaped arrangement of said helical pipes, and the opposite ends of said U-shaped heater are mounted in said through bores from the connected ends of said helical pipes.

15. A cooling device as defined in claim 7 wherein said heater has at its opposite ends lead wire terminals, and said terminals and the inlet and outlet of said refrigerant passageway are positioned on one side of said cooling device.

16. A cooling device as defined in claim 8 wherein said heater has a flat pipe portion at the bent portin of the U-shaped arrangement.

17. A device for heating and cooling a flowing stream of air, comprising:

a helically wound thermally conductive metal pipe, the helical axis of said pipe being generally perpendicular to the direction of air flow;

a heater extending along said helical axis; and radial spine fins projecting from the entire surface of said helical pipe, said spine fins being in thermally conductive relationship with both said helical pipe and said heater.

* * * * *